US008995884B2

(12) United States Patent
Kato et al.

(10) Patent No.: US 8,995,884 B2
(45) Date of Patent: Mar. 31, 2015

(54) DEVELOPING APPARATUS AND IMAGE FORMING APPARATUS

(71) Applicants: Shuichi Kato, Nagoya (JP); Seiichi Senda, Anjo (JP); Tomoaki Hattori, Nagoya (JP); Masanari Yoshikawa, Nagoya (JP)

(72) Inventors: Shuichi Kato, Nagoya (JP); Seiichi Senda, Anjo (JP); Tomoaki Hattori, Nagoya (JP); Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 36 days.

(21) Appl. No.: 13/852,515

(22) Filed: Mar. 28, 2013

(65) Prior Publication Data

US 2013/0287445 A1 Oct. 31, 2013

(30) Foreign Application Priority Data

Apr. 25, 2012 (JP) ..... 2012-100229

(51) Int. Cl.
*G03G 15/08* (2006.01)

(52) U.S. Cl.
CPC ..... *G03G 15/0832* (2013.01); *G03G 15/0877* (2013.01); *G03G 15/0891* (2013.01); *G03G 15/0896* (2013.01); *G03G 15/0865* (2013.01); *Y10S 222/01* (2013.01)
USPC ..... 399/258; 399/111; 399/262; 222/DIG. 1

(58) Field of Classification Search
USPC ..... 399/110, 111, 119, 258, 262; 222/DIG. 1
See application file for complete search history.

(56) References Cited

U.S. PATENT DOCUMENTS

| | | | | |
|---|---|---|---|---|
| 7,860,437 | B2 | 12/2010 | Kakuta et al. | |
| 8,391,752 | B2 | 3/2013 | Sato | |
| 2008/0175627 | A1* | 7/2008 | Sato | 399/254 |
| 2008/0240775 | A1* | 10/2008 | Mase | 399/111 |
| 2008/0247784 | A1 | 10/2008 | Kakuta et al. | |
| 2009/0087216 | A1* | 4/2009 | Sakuma | 399/106 |
| 2011/0076062 | A1 | 3/2011 | Kakuta et al. | |
| 2011/0103844 | A1* | 5/2011 | Sato | 399/262 |
| 2012/0170955 | A1 | 7/2012 | Kakuta et al. | |

FOREIGN PATENT DOCUMENTS

| | | | |
|---|---|---|---|
| JP | 2008-170951 | A | 7/2008 |
| JP | 2009-222945 | A | 10/2009 |
| JP | 2010-190975 | A | 9/2010 |
| JP | 2011-095578 | A | 5/2011 |

* cited by examiner

*Primary Examiner* — David Gray
*Assistant Examiner* — Francis Gray
(74) *Attorney, Agent, or Firm* — Banner & Witcoff, Ltd.

(57) ABSTRACT

A developing apparatus is provided, including a developing unit including a developing roller; a developer accommodating unit; a partition wall partitioning the developing unit and the developer accommodating unit; a supply port which makes communication between the developing unit and the developer accommodating unit; a transport member configured so that the developer accommodated in the developer accommodating unit is supplied to the developing unit via the supply port in accordance with rotation; a return port configured so that the developer contained in the developing unit is permitted to fall into the developer accommodating unit; an opening/closing member configured to be movable between an open position for opening the return port and a closed position for closing the return port; and a driving mechanism configured so that the opening/closing member is moved to the closed position and the open position.

18 Claims, 6 Drawing Sheets

DEVELOPING APPARATUS AND IMAGE FORMING APPARATUS

CROSS REFERENCE TO RELATED APPLICATION

The present application claims priority from Japanese Patent Application No. 2012-100229, filed on Apr. 25, 2012, the disclosure of which is incorporated herein by reference in its entirety.

BACKGROUND OF THE INVENTION

1. Field of the Invention:

The present invention relates to a developing apparatus and an image forming apparatus including a developing unit and a developer accommodating unit which is provided under or below the developing unit and which accommodates a developer.

2. Description of the Related Art:

Conventionally, a developing apparatus is known, including a developing unit provided with a developing roller, and a developer accommodating unit provided under or below the developing unit to accommodate a developer. In the developing apparatus as described above, those provided between the developing unit and the developer accommodating unit which are aligned vertically are a partition wall which partitions the developing unit and the developer accommodating unit, and a supply port which makes communication between the developing unit which uses a part of the partition wall as a bottom thereof and the developer accommodating unit.

In the developing apparatus, the developer, which is accommodated in the developer accommodating unit, is supplied to the developing unit via the supply port by means of a transport member provided in the developer accommodating unit.

SUMMARY OF THE INVENTION

In the meantime, the electrification or charging of the developer is uneven, and the developer, which has a large electric charge amount or electrification amount, is preferentially and selectively used for the development. Therefore, the developer, which has a small electric charge amount and which is not used for the development, remains in the developing unit. However, in the case of the technique as described above, the developer, which is contained in the developing unit, is not returned to the developer accommodating unit. Therefore, the developer, which has the small electric charge amount, is consequently accumulated in the developing unit.

In view of the above, an object of the present teaching is to provide a developing apparatus which makes it possible to return a developer contained in a developing unit to a developer accommodating unit.

According to a first aspect of the present teaching, there is provided a developing apparatus configured to perform development by using a developer, the developing apparatus including:

a developing unit including a developing roller;

a developer accommodating unit provided under or below the developing unit and configured to accommodate the developer;

a partition wall configured to construct at least a bottom of the developing unit and partitioning the developing unit and the developer accommodating unit;

a supply port configured to make communication between the developing unit and the developer accommodating unit and configured so that the developer accommodated in the developer accommodating unit is permitted to move to the developing unit;

a transport member provided in the developer accommodating unit and configured so that the developer accommodated in the developer accommodating unit is supplied to the developing unit via the supply port in accordance with rotation;

a return port formed at a portion corresponding to the bottom of the developing unit constructed by the partition wall and configured so that the developer contained in the developing unit is permitted to fall into the developer accommodating unit;

an opening/closing member provided for the developing unit and configured to be movable between an open position for opening the return port and a closed position for closing the return port; and a driving mechanism configured so that the opening/closing member is moved to the closed position and the open position.

According to the developing apparatus constructed as described above, the opening/closing member is opened/closed, and thus the developer contained in the developing unit can be occasionally returned to the developer accommodating unit. Therefore, it is possible to reduce the accumulation of the developer having a small amount of electric charge in the developing unit. The developer, which is returned to the developer accommodating unit, is agitated in accordance with the rotation of the transport member. Accordingly, it is possible to obtain a sufficient amount of electric charge. Further, the opening/closing member is moved, and thus the developer contained in the developing unit is loosened. Therefore, it is possible to reduce the solidification of the developer at any part.

According to a second aspect of the present teaching, there is provided an image forming apparatus configured to form an image on a medium, including:

the developing apparatus in accordance with the first aspect of the present teaching;

a photosensitive member arranged opposingly to the developing roller;

an exposure apparatus arranged opposingly to the photosensitive member at a position different from that of the developing roller and configured to expose the photosensitive member;

an endless belt arranged over or above each of the photosensitive member;

a primary transfer roller arranged opposingly to each of the photosensitive member between each of the photosensitive member and the primary transfer roller with the endless belt intervening therebetween; and a secondary transfer roller arranged on one end side of the endless belt.

According to a third aspect of the present teaching, there is provided a developing apparatus including:

a developing roller;

a transport member;

a casing comprising a partition wall which partitions a first chamber in which the developing roller is disposed and a second chamber configured to accommodate developer and disposed below the first chamber, the partition wall having:

a supply port for making communication between the first chamber and the second chamber, the transport member being disposed in the second chamber and configured to supply the developer accommodated in the second chamber to the first chamber via the supply port; and a return port for permitting the developer contained in the first chamber to fall into the second chamber; and an moving member configured to be move between an open position for opening the return port and a closed position for closing the return port.

BRIEF DESCRIPTION OF THE DRAWINGS

FIGS. 5A and 5B show the developing cartridge, wherein FIG. 5A shows a state in which the opening/closing member closes a return port, and FIG. 5B shows a state in which the opening/closing member opens the return port.

FIGS. 6A and 6B show a developing cartridge according to a modified embodiment, wherein FIG. 6A shows a state in which an opening/closing member closes a return port, and FIG. 6B shows a state in which the opening/closing member opens the return port.

DESCRIPTION OF THE PREFERRED EMBODIMENTS

Next, an embodiment of the present invention will be explained in detail appropriately with reference to the drawings. In the following description, the overall arrangement of a color printer 1 including a developing cartridge 100 will be firstly explained as an example of the developing apparatus, and then details of the feature of the present invention will be explained.

In the following description, the directions will be explained by using the directions as provided on the basis of a user upon the use of the color printer 1. That is, as viewed in FIG. 1, the left side, which is provided while confronting the paper surface, is defined as "front side (forward side)", and the right side, which is provided while confronting the paper surface, is defined as "rear side (rearward side)". Further, the forward side, which is provided while confronting the paper surface, is defined as "right side", and the backward side, which is provided while confronting the paper surface, is defined as "left side". Further, the upward-downward direction, which is provided while confronting the paper surface, is defined as "up-down direction".

<Overall Arrangement of Color Printer>

Figure 1:
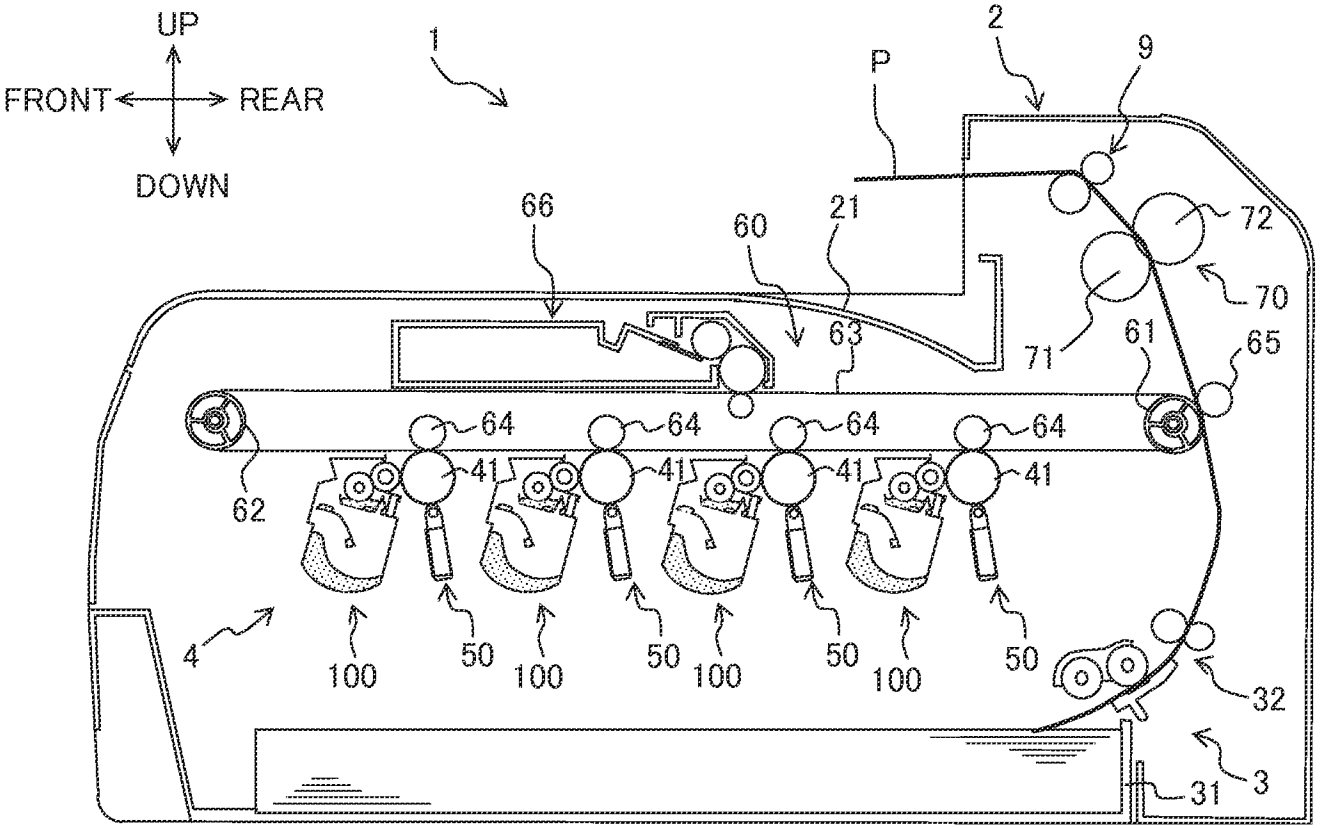
FIG. 1 shows a schematic arrangement of a color printer provided with a developing cartridge according to one embodiment of the present teaching.

As shown in FIG. 1, the color printer 1 mainly includes a main body 2, a paper feed unit 3 configured to supply the printing paper P, an image forming unit 4 configured to form an image on the supplied printing paper P, and a paper discharge roller 9 configured to discharge the printing paper P on which the image has been formed.

A discharge tray 21, on which the printing paper P discharged from the main body 2 is placed, is provided at an upper portion of the main body 2.

The paper feed unit 3 includes a paper feed tray 31 provided at a lower portion in the main body 2 and installed to the main body 2 removably, and a paper feed mechanism 32 configured to transport the printing paper P fed from the paper feed tray 31 to the transfer position of the image forming unit 4 (between an intermediate transfer belt 63 and a secondary transfer roller 65). The printing paper P, which is accommodated in the paper feed tray 31, is separated one by one by the paper feed mechanism 32, and the printing paper P is transported to the transfer position.

The image forming unit 4 is principally composed of four photosensitive drums 41, unillustrated electrifiers (chargers), four developing cartridges 100, four LED units 50, a transfer unit 60, and a fixing unit 70.

The four photosensitive drums 41 are aligned in the front-rear direction. Each of the photosensitive drums 41 is arranged so that the photosensitive drum 41 is opposed to the intermediate transfer belt 63 under or below the intermediate transfer belt 63 as described later on. An upper portion of each of the photosensitive drums 41 is brought in contact with a primary transfer roller 64 with the intermediate transfer belt 63 intervening therebetween.

Figure 2:
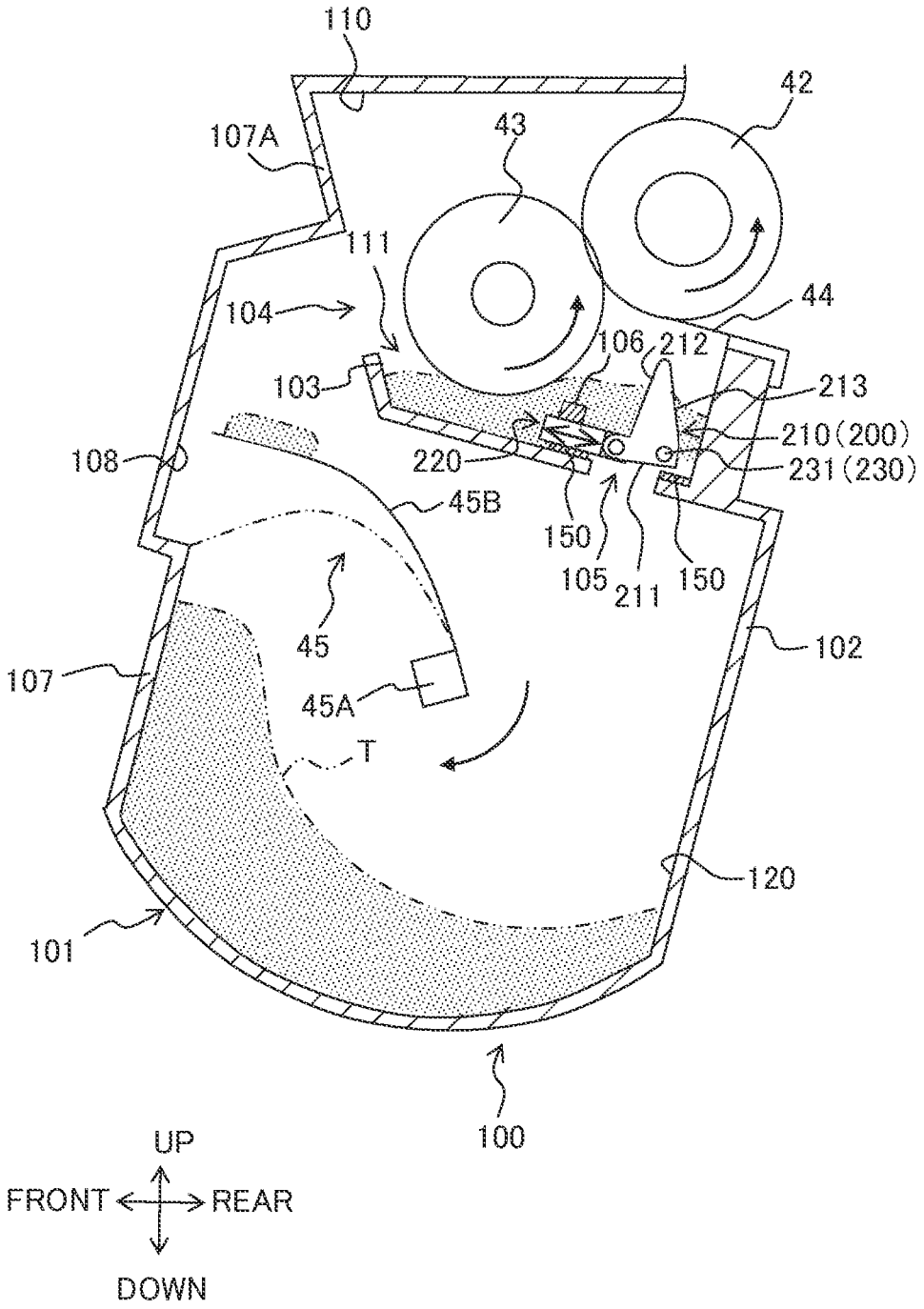
FIG. 2 shows a developing cartridge.

As shown in FIG. 2, the developing cartridge 100 principally includes a developing roller 42, a supply roller 43 as an example of the supply member, a layer thickness regulating blade 44, and a toner transport member 45 as an example of the transport member. With reference to FIG. 1, each of the four developing cartridges 100 is arranged forwardly with respect to each of the four photosensitive drums 41, which is provided corresponding to each of the four photosensitive drums 41. Detailed arrangement of the developing cartridge 100 will be described later on.

The four LED units 50 are provided corresponding to the plurality of photosensitive drums 41 respectively. Each of the LED units 50 is arranged opposingly to the photosensitive drum 41 under or below the corresponding photosensitive drum 41. The LED unit 50 is constructed such that the light-emitting element of the LED unit 50 is turned ON/OFF on the basis of the image data, and thus the surface of the photosensitive drum 41 is exposed.

The transfer unit 60 is provided between the four photosensitive drums 41 and the discharge tray 21, and the transfer unit 60 includes a driving roller 61, a driven roller 62, the intermediate transfer belt 63 having an endless shape provided in a stretched form between the driving roller 61 and the driven roller 62, four primary transfer rollers 64 arranged opposingly to the photosensitive drums 41 with the intermediate transfer belt 63 intervening therebetween, a secondary transfer roller 65 arranged opposingly to the driving roller 61 with the intermediate transfer belt 63 intervening therebetween, and a cleaning unit 66 arranged over or above the intermediate transfer belt 63 on the front side and which removes the toner T (developer) disposed on the intermediate transfer belt 63.

The fixing unit 70 is provided over or above the intermediate transfer belt 63 on the rear side, and the fixing unit 70 principally includes a heating roller 71, and a pressing roller 72 arranged opposingly to the heating roller 71 and configured to press the heating roller 71.

In the image forming unit 4 constructed as described above, the surfaces of the respective photosensitive drums 41 are uniformly charged by the chargers (not shown), and then the surfaces are exposed by means of the LED units 50. Accordingly, the electric potentials are lowered at the exposed portions of the surfaces of the photosensitive drums 41, and electrostatic latent images, which are based on the image data, are formed on the respective photosensitive drums 41. The toners T, which are contained in the developing cartridges 100, are agitated by the toner transport members 45, and thus the toners T are frictionally charged. After that, the toners T are supplied to the developing rollers 42 by the aid of the supply rollers 43.

The toners T carried on the developing rollers 42 are supplied from the developing rollers 42 to the electrostatic latent images on the photosensitive drums 41. Accordingly, the electrostatic latent images are converted into visual images, and toner images are formed on the photosensitive drums 41. The toner images, which are formed on the respective photosensitive drums 41, are successively overlaid and transferred onto the intermediate transfer belt 63 in accordance with the action of the respective primary transfer rollers 64 to each of which the transfer bias is applied.

The toner images, which are transferred to the intermediate transfer belt 63, are transferred onto the printing paper P in accordance with the action of the secondary transfer roller 65 to which the transfer bias is applied, when the printing paper P, which is supplied to the image forming unit 4, passes through the space between the intermediate transfer belt 63 and the secondary transfer roller 65. The printing paper P, to which the toner images are transferred, is transported to the fixing unit 70. The printing paper P passes through the space between the heating roller 71 and the pressing roller 72, and thus the toner images are thermally fixed. The printing paper P, on which the toner images are thermally fixed, is discharged to the outside of the main body 2 by means of the paper discharge roller 9, and the printing paper P is accumulated in the discharge tray 21.

<Detailed Arrangement of Developing Cartridge>

Next, an explanation will be made about the detailed arrangement of the developing cartridge 100 as the feature of the present teaching.

As shown in FIG. 2, the developing cartridge 100 includes a casing 101 provided with a developing unit 110 and a toner accommodating unit 120 arranged under or below the developing unit 110 and provided as an example of the developer accommodating unit for accommodating the toner T.

The developing cartridge 100 principally includes the developing roller 42, the supply roller 43, the layer thickness regulating blade 44, and an opening/closing member 200 arranged in the developing unit 110, the toner transport member 45 arranged in the toner accommodating unit 120, and a gear mechanism 130 (see FIG. 4) arranged on the right side surface of the casing 101.

The casing 101 of the developing cartridge 100 includes a partition wall 103 extending forwardly from a back wall 102. Accordingly, the interior of the casing 101 is partitioned, and the developing unit 110 and the toner accommodating unit 120 are formed. The partition wall 103 constitutes the bottom of the developing unit 110.

An opening is formed at a back portion of the developing unit 110. The developing roller 42 is arranged so that the developing roller 42 is exposed to the outside via the opening.

The supply roller 43 is arranged obliquely downwardly in front of the developing roller 42 so that the supply roller 43 is brought in contact with the developing roller 42 over or above the partition wall 103.

In this arrangement, the partition wall 103 has a bent shape so that the partition wall 103 is arranged downwardly from the supply roller 43 and obliquely downwardly in front of the supply roller 43. The partition wall 103 is formed to have a substantially L-shaped form. Specifically, the partition wall 103 passes under or below the supply roller 43 from the back wall 102 to extend obliquely upwardly in the forward direction, and then the partition wall 103 further extends obliquely upwardly in the upward direction while being inclined toward the supply roller 43 so that the partition wall 103 extends to a position disposed forwardly from the supply roller 43. Accordingly, the toner T is stored on the lower side of the supply roller 43. A supply port 104, which makes communication between the developing unit 110 and the toner accommodating unit 120, is formed between the forward end of the partition wall 103 and a wall 107A of the casing 101 arranged on an extension line of the forward end of the partition wall 103. The supply port 104 permits the toner T accommodated in the toner accommodating unit 120 to move to the developing unit 110.

Further, a return port 105, which penetrates in the upward-downward direction, is formed at a portion of the partition wall 103 corresponding to the bottom of the developing unit 110, i.e., the portion of the partition wall 103 included in the portion extending from the back wall 102 to the position disposed under or below the supply roller 43 and arranged under or below the developing roller 42. The return port 105 is constructed so that the toner T contained in the developing unit 110 is permitted to fall into the toner accommodating unit 120.

The layer thickness regulating blade 44 is provided so that the layer thickness regulating blade 44 is brought in contact with the outer circumferential surface of the developing roller 42 at the downward position. Specifically, the proximal end portion of the layer thickness regulating blade 44 is supported by the back wall 102 of the casing 101. The forward end portion of the layer thickness regulating blade 44 extends to the position disposed under the developing roller 42, which is brought in contact with the developing roller 42. The contact portion of the layer thickness regulating blade 44, which is brought in contact with the developing roller 42, is arranged over or above the return port 105. Accordingly, the toner T, which is scraped off by the layer thickness regulating blade 44, falls to the positions around the return port 105.

Figure 3A:
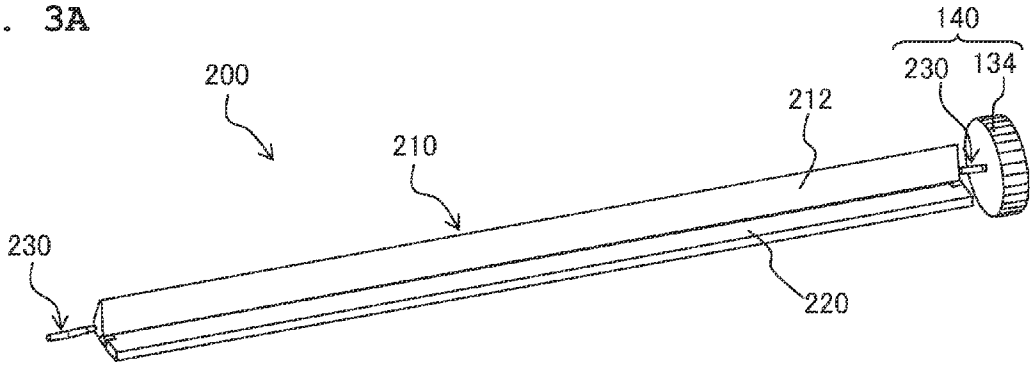
FIG. 3A shows a perspective view illustrating an opening/closing member.

The opening/closing member 200 is the member configured to open/close the return port 105. The opening/closing member 200 is constructed to be movable between the open position (position shown in FIG. 5B) at which the return port 105 is open and the closed position (position shown in FIG. 5A) at which the return port 105 is closed. As shown in FIGS. 2 and 3A, the opening/closing member 200 principally includes a main body portion 210, a support portion 220, and a shaft portion 230.

The main body portion 210 is the portion of the opening/closing member 200 arranged on the return port 105. The main body portion 210 is formed to have a substantially triangular shape as viewed in a side view. The main body portion 210 has a first surface 211 which is opposed to the return port 105 and which is formed to have substantially the same size as that of the return port 105, a second surface 212 which is opposed to the supply roller 43, and a third surface 213 which is opposed to the back wall 102 of the casing 101.

The support portion 220 is arranged at the forward position with respect to the main body portion 210. The support portion 220 supports a front lower portion of the main body portion 210 (portion protruding forwardly from a lower portion of the second surface 212) so that the main body portion 210 is swingable with respect to the support portion 220. The support portion 220 is arranged so that the support portion 220 is interposed between stoppers 106 provided on the left and right walls of the casing 101 and the partition wall 103 (in particular a seal member 150 provided on the partition wall 103 as described later on) in the up-down direction. Accordingly, the movement of the support portion 220 in the up-down direction is regulated, and the movement of the support portion 220 in the front-rear direction is permitted.

The main body portion 210 and the support portion 220 form the wall portion arranged between the supply roller 43 and the return port 105. A storage unit 111, which is substantially U-shaped as viewed in a sectional view and which is provided to store the toner T, is formed by the second surface 212 of the main body portion 210, the upper surface of the support portion 220, and the surface of the partition wall 103 disposed on the side of the developing unit 110. As for the main body portion 210, the toner T can be also stored between the third surface 213 of the main body portion 210 and the surface of the back wall 102 disposed on the front side. This space principally stores the toner T which overflows from the storage unit 111 and the toner T which is scraped off by the layer thickness regulating blade 44.

Figure 3B:
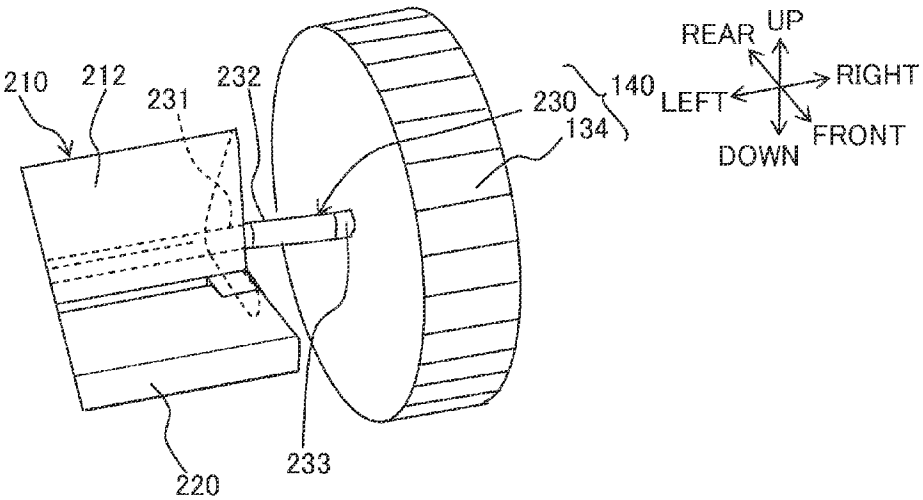
FIG. 3B shows an enlarged view illustrating a right end portion of the opening/closing member.

The shaft portion 230 is the shaft inserted into the hole that is formed at a lower portion of the main body portion 210 disposed on the back side to penetrate in the left-right direction. As shown in FIG. 3B, the shaft portion 230 is formed to extend in the left-right direction. Each of the both ends portions in the left-right direction has a first portion 231 which protrudes outwardly from the hole of the main body portion 210, a second portion 232 which extends in an oblique direction intersecting the left-right direction from each of the both ends of the first portions 231, and a third portion 233 which extends outwardly in the left-right direction from the end portion of the second portion 232 disposed on the side opposite to the first portion 231. The portions of the shaft portion 230, which are exposed from the main body portion 210, are bent in substantially S-shaped forms. In other words, the first portion 231 is arranged at the position which is deviated in the radial direction of the third portion 233 with respect to the third portion 233.

The third portion 233 of the shaft portion 230 disposed at the left end is fixed to the center of rotation of an opening/closing member driving gear 134 of a gear mechanism 130 as described later on. A driving mechanism 140, which moves the opening/closing member 200 to the closed position and the open position, is constructed by the shaft portion 230 and the opening/closing member driving gear 134.

Specifically, when the first portion 231 of the shaft portion 230 is positioned at the lowermost position with respect to the third portion 233, the opening/closing member 200 is arranged at the closed position at which the main body portion 210 approaches the return port 105 most closely. On the other hand, when the first portion 231 of the shaft portion 230 is positioned at the uppermost position with respect to the third portion 233, then the opening/closing member 200 is arranged upwardly as compared with when the main body portion 210 is arranged at the closed position, and the opening/closing member 200 is arranged at the open position separated upwardly farthest from the return port 105. The first portion 231 circles about the center of the third portion 233 in accordance with the rotation of the opening/closing member driving gear 134, and thus the opening/closing member 200 is moved between the closed position and the open position. A specified operation of the opening/closing member 200 will be described later on.

As shown in FIG. 2, the seal member 150, which is formed of, for example, sponge, is provided between the edge of the return port 105 and the opening/closing member 200. The seal member 150 prevents the toner T contained in the developing unit 110 from falling into the toner accommodating unit 120 through any space between the edge of the return port 105 and the opening/closing member 200 when the opening/closing member 200 is positioned at the closed position.

The toner accommodating unit 120 is formed to have a hollow and substantially columnar form. The toner accommodating unit 120 is communicated with the developing unit 110 via the supply port 104 disposed at the upper position. The toner transport member 45 is provided in the toner accommodating unit 120.

The toner transport member 45 is principally includes a rotational shaft 45A rotatably supported by the casing 101, and a film member 45B having flexibility and configured to extend outwardly in the radial direction from the rotational shaft 45A. The toner transport member 45 has the film member 45B which is rotatable while making sliding contact with the inner surface of the casing 101. Accordingly, the toner T, which is accommodated in the toner accommodating unit 120, is agitated by rotating the toner transport member 45.

The toner accommodating unit 120 has a recess 108 which is recessed forwardly and which is formed at an upper portion of a front wall 107. The recess 108 is provided to range from a portion disposed below the partition wall 103 to an upper portion of the supply port 104 in the up-down direction. Accordingly, when the film member 45B, which is rotated while being flexibly bent and making sliding contact with the front wall 107, arrives at the recess 108, the forward end is released to spring up. Therefore, the toner T, which has been placed on the film member 45B, is allowed to fly toward the supply port 104, and the toner T is transported to the developing unit 110.

Figure 4:
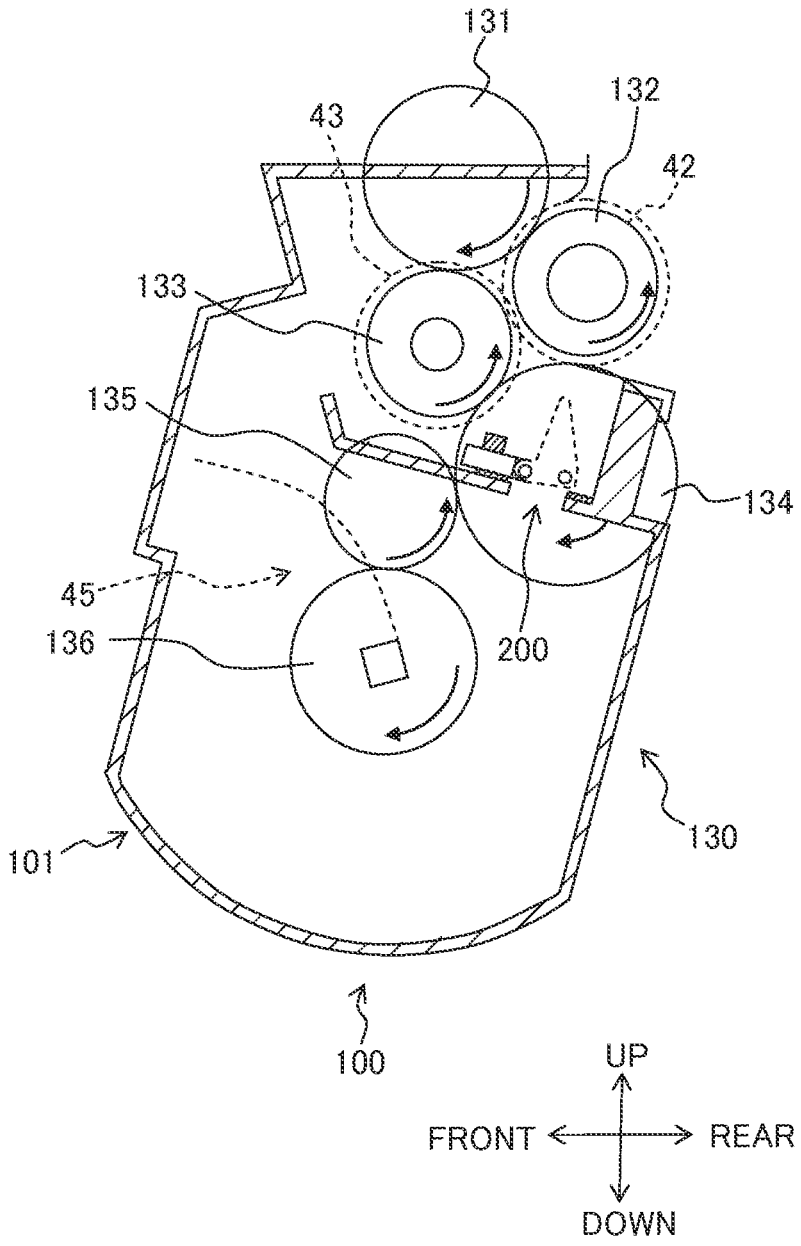
FIG. 4 shows a driving mechanism.

As shown in FIG. 4, the gear mechanism 130 is constructed to include an input gear 131 to which the driving force is transmitted from an unillustrated motor provided on the side of the main body 2, a developing roller driving gear 132 and a supply roller driving gear 133 which are directly meshed with the input gear 131, an opening/closing member driving gear 134 which is meshed with the supply roller driving gear 133, and a toner transport member driving gear 136 which is meshed with the opening/closing member driving gear 134 with an intermediate gear 135 intervening therebetween. In this arrangement, the developing roller driving gear 132, the supply roller driving gear 133, and the toner transport member driving gear 136 are provided integrally at the end portions of the respective shafts of the developing roller 43, the supply roller 43, and the toner transport member 45 respectively.

As described above, the opening/closing member driving gear 134 is provided integrally at the end portion of the shaft portion 230 of the opening/closing member 200 (see FIG. 3B). Further, the opening/closing member driving gear 134 for rotating the opening/closing member 200 and the toner transport member driving gear 136 for rotating the toner transport member are connected as described above, and thus the opening/closing operation of the opening/closing member 200 can be interconnected with the rotational operation of the toner transport member 45.

Next, the operation of the opening/closing member 200 will be explained. When the driving force is transmitted from the motor to the input gear 131, the developing roller driving gear 132, the supply roller driving gear 133, the opening/closing member driving gear 134, and the toner transport member driving gear 136 begin to rotate.

Figure 5A:
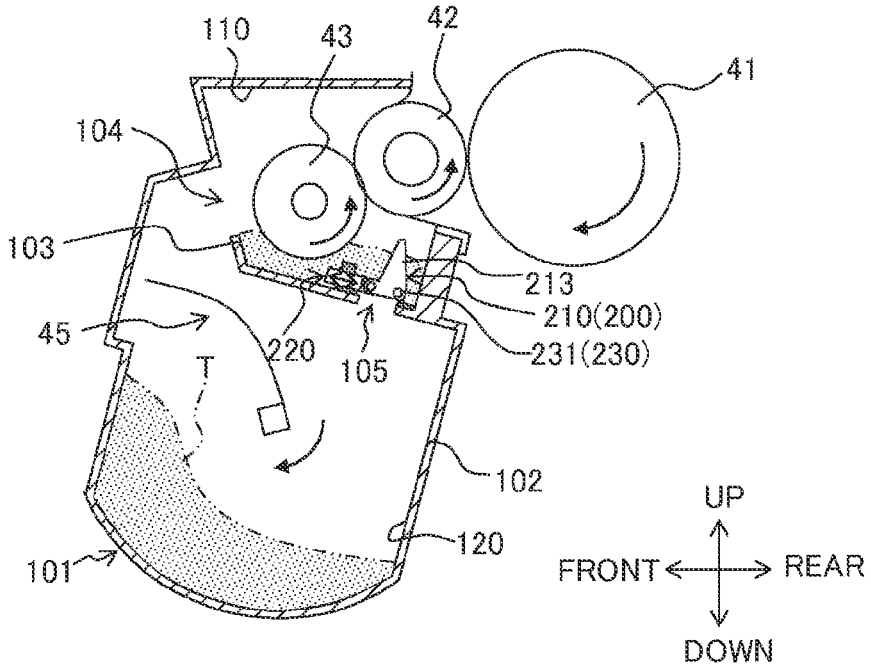

As for the opening/closing member 200, as described above, when the first portion 231 of the shaft portion 230 is positioned at the lowermost position with respect to the third portion 233, the opening/closing member 200 is positioned at the closed position for closing the return port 105 as shown in FIG. 5A. When the opening/closing member driving gear 134 is rotated clockwise as shown in FIG. 4, the first portion 231 of the shaft portion 230 begin to move obliquely upwardly in the forward direction. In accordance therewith, the support portion 220 is moved forwardly, while the back end of the main body portion 210 is allowed to swing upwardly. Accordingly, the opening/closing member 200 opens the return port 105. After the first portion 231 of the shaft portion 230 is rotated by about 90 degrees from the position of being arranged at the closed position, the movement begins obliquely upwardly in the backward direction. In accordance therewith, the support portion 220 is moved backwardly, while the back end of the main body portion 210 is allowed to swing further upwardly.

Figure 5B:
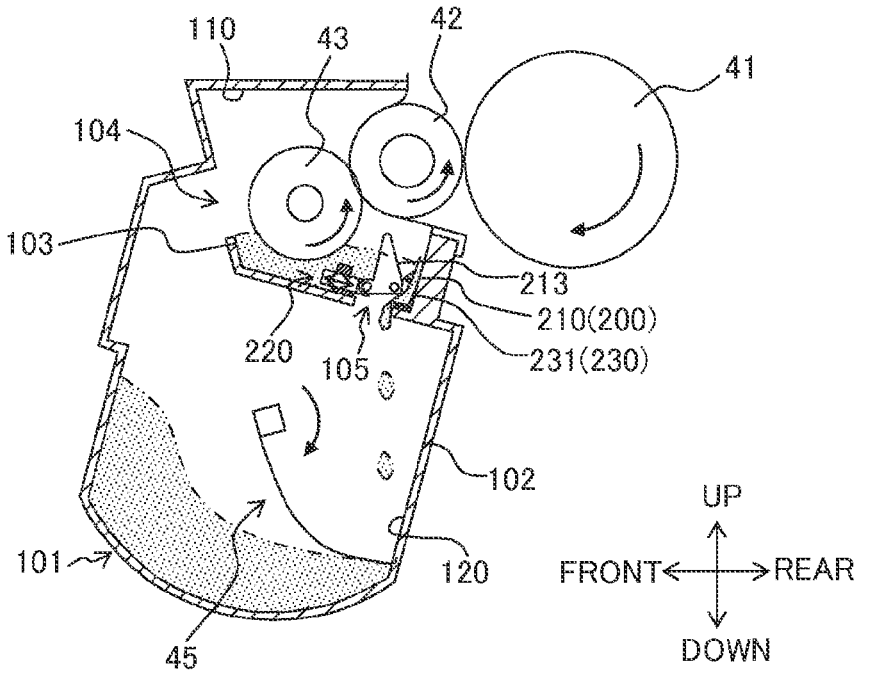

When the first portion 231 of the shaft portion 230 is positioned at the uppermost position (when it is rotated by about 180 degrees from the position of being arranged at the closed position), as shown in FIG. 5B, the opening/closing member 200 is positioned at the open position at which the main body portion 210 is arranged most upwardly.

When the opening/closing member driving gear 134 is further rotated, the first portion 231 of the shaft portion 230 begins to move obliquely downwardly in the backward direction. In accordance therewith, the support portion 220 is moved backwardly, while the back end of the main body portion 210 is allowed to swing downwardly. After the first portion 231 of the shaft portion 230 is rotated by about 90 degrees from the position of being arranged at the open position, the movement begins obliquely downwardly in the forward direction. In accordance therewith, the support portion 220 is moved forwardly, while the lower end of the main body portion 210 is allowed to swing further downwardly, and the opening/closing member 200 is moved to the closed position.

According to the foregoing description, it is possible to obtain the following function and effect in this embodiment. The opening/closing member 200 is moved to the open position and the closed position to open/close the return port 105. Accordingly, the toner T, which has been stored between the third surface 213 and the back wall 102 in the developing unit 110, which has the small amount of electric charge, and which is not used for the development, for example, by being scraped off by the layer thickness regulating blade 44, can be occasionally returned to the toner accommodating unit 120. Accordingly, it is possible to reduce the accumulation of the toner T having the small electric charge amount in the developing unit 110. Further, the toner T, which is returned to the toner accommodating unit 120, is agitated by rotating the toner transport member 45. Thus, the toner T can be sufficiently charged even when the returned toner T has the small electric charge amount. Further, the toner T, which is contained in the developing unit 110 (especially in the storage unit 111 around the supply roller 43), is loosened by allowing the main body portion 210 of the opening/closing member 200 to swing. Therefore, it is possible to reduce the solidification of the toner T at any part.

The opening/closing member 200 is provided between the supply roller 43 and the return port 105, and the storage unit 111 is formed by the second surface 212 and the surface of the partition wall 103 disposed on the side of the supply roller 43. Accordingly, even when the opening/closing member 200 is moved to the open position, the toner T, which is stored in the storage unit 111, does not fall from the return port 105. Accordingly, it is possible to suppress any sudden decrease in the toner T around the supply roller 43 when the opening/closing member 200 opens the return port 105.

The driving mechanism 140, which is configured to move the opening/closing member 200 to the open position and the closed position, is operated interconnectedly with the rotational operation of the toner transport member 45. Therefore, the opening/closing member 200 is moved periodically, and the toner T contained in the developing unit 110 is returned to the toner accommodating unit 120. Further, the toner T contained in the developing unit 110 is loosened. Accordingly, the fluidity of the toner T is improved in the developing cartridge 100 and in the developing unit 110.

Further, the seal member 150 is provided between the edge of the return port 105 and the opening/closing member 200. Therefore, it is possible to reduce the leakage of the toner T from any gap between the return port 105 and the opening/closing member 200 positioned at the closed position. Accordingly, it is possible to correctly manage the amount of the toner T to be returned from the developing unit 110 to the toner accommodating unit 120.

The embodiment of the present teaching has been explained above. However, the present teaching is not limited to the embodiment described above. The specified construction can be appropriately changed within a scope without deviating from the gist or essential characteristics of the present teaching.

In the embodiment described above, the opening/closing member 200 has the main body portion 210 which is swingable in the up-down direction, and the support portion 220 which is movable in the front-rear direction. However, the present teaching is not limited thereto. For example, the main body of the opening/closing member 200 may be formed by one part.

Figure 6A:
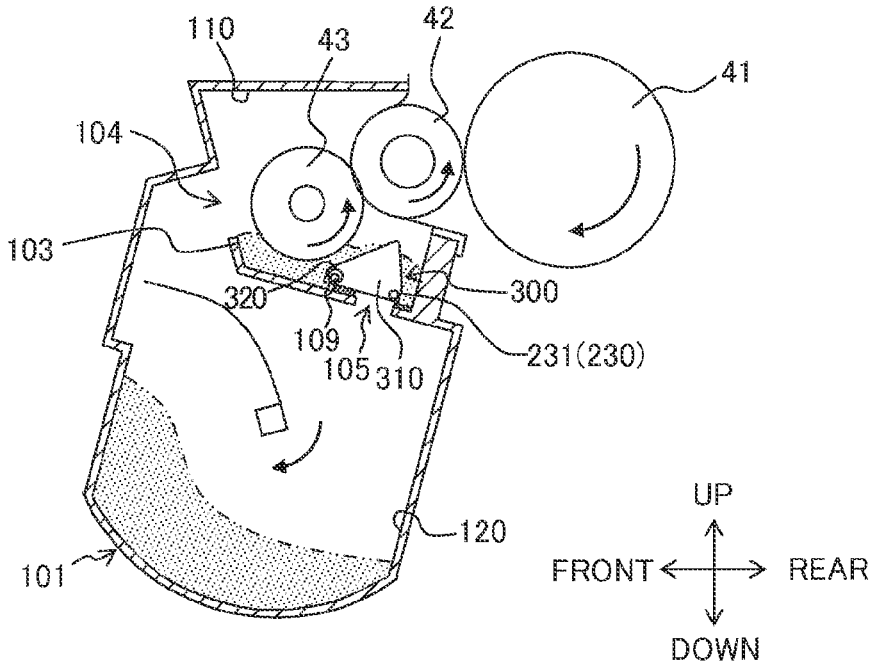

Specifically, as shown in FIG. 6A, an opening/closing member 300 includes a main body portion 310 configured to be substantially triangular as viewed in a side view, and a shaft portion 230 which is the same as or equivalent to that of the embodiment described above. The main body portion 310 has holes 320 disposed at front end portions of left and right side surfaces. Support shafts 109, which are formed on the side walls of the casing 101, are loosely fitted to the holes.

Figure 6B:
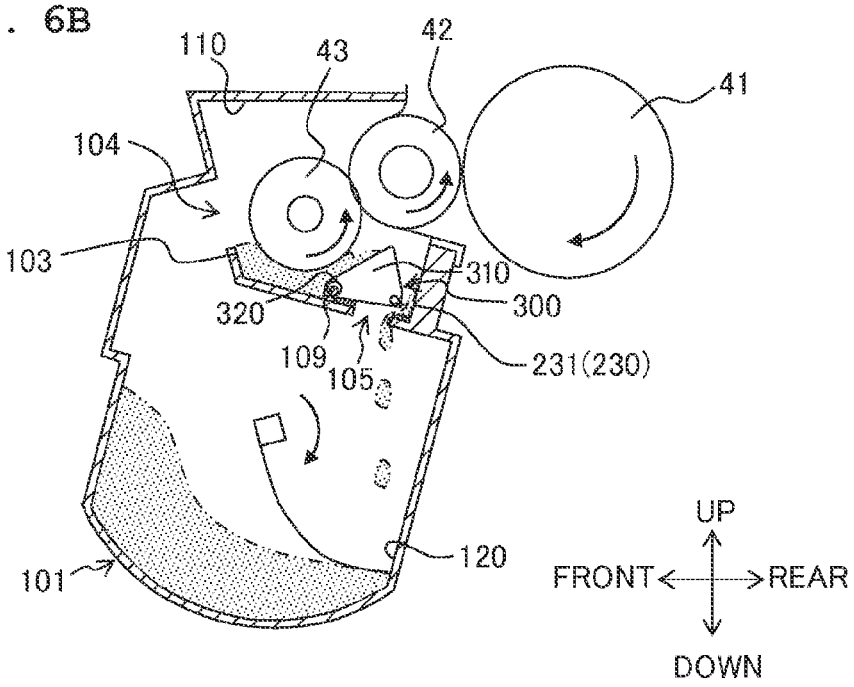

The opening/closing member 300 constructed as described above is movable in the up-down direction and in the left-right direction. Therefore, the opening/closing member 300 can be moved in conformity with the operation of the first portion 231 of the shaft portion 230. In other words, when the shaft portion 230 is rotated from the closed position at which the opening/closing member 300 closes the return port 105 as shown in FIG. 6A, and the first portion 231 is moved upwardly, then the opening/closing member 300 is moved to the open position at which the opening/closing member 300 opens the return port 105 as shown in FIG. 6B.

What is claimed is:

1. A developing apparatus configured to perform development by using a developer, the developing apparatus comprising:

a developing unit including a developing roller;

a developer accommodating unit provided under the developing unit and configured to accommodate the developer;

a partition wall configured to form at least a bottom of the developing unit and partitioning the developing unit and the developer accommodating unit;

a supply port configured to make communication between the developing unit and the developer accommodating unit and configured so that the developer accommodated in the developer accommodating unit is permitted to move to the developing unit;

a transport member provided in the developer accommodating unit and configured to supply the developer accommodated in the developer accommodating unit to the developing unit via the supply port in accordance with rotation;

a return port formed at a portion corresponding to the bottom of the developing unit formed by the partition wall and configured to permit the developer contained in the developing unit to fall into the developer accommodating unit;

an opening/closing member provided for the developing unit and configured to be movable between an open position for opening the return port and a closed position for closing the return port, wherein, in a case where the opening/closing member is in the closed position, the supply port is open and allows developer accommodated in the developer accommodating unit to move to the developing unit; and a driving mechanism configured to move the opening/closing member between closed position and the open position.

2. The developing apparatus according to claim 1, further comprising a supply member provided for the developing unit and configured to supply the developer to the developing roller;

a wall portion provided between the supply member and the return port; and a storage unit storing the developer, the storage unit formed by a surface of the wall portion disposed on a side of the supply member and a surface of the partition wall disposed on a side of the developing unit.

3. The developing apparatus according to claim 1, wherein the driving mechanism is configured to operate interconnectedly with a rotation operation of the transport member.

4. The developing apparatus according to claim 1, wherein a seal member is provided between the partition wall and the opening/closing member.

5. The developing apparatus according to claim 1, wherein the opening/closing member has a substantially triangular prism-shaped main body portion having a bottom surface opposed to the return port and configured to extend in an extending direction, and includes a shaft portion protruding outwardly from both ends of the main body portion in the extending direction, and wherein the shaft portion is bent in a substantially S-shaped form so that the shaft portion has a connecting portion to be connected to the main body portion, and an end portion disposed on a side opposite to the main body portion, the shaft portion and the end portion arranged at positions deviated from each other in relation to a plane perpendicular to the extending direction.

6. An image forming apparatus configured to form an image on a medium, comprising:

the developing apparatus of claim 1;

a photosensitive member arranged opposingly to the developing roller;

an exposure apparatus arranged opposingly to the photosensitive member at a position different from that of the developing roller and configured to expose the photosensitive member;

an endless belt arranged over or above the photosensitive member;

a primary transfer roller arranged opposingly to the photosensitive member between the photosensitive member and the primary transfer roller with the endless belt intervening therebetween; and a secondary transfer roller arranged on one end side of the endless belt.

7. A developing apparatus comprising:

a developing roller;

a transport member;

a casing comprising a partition wall which partitions a first chamber in which the developing roller is disposed and a second chamber configured to accommodate developer and disposed below the first chamber, the partition wall having:

a supply port providing communication between the first chamber and the second chamber, the transport member being disposed in the second chamber and configured to supply the developer accommodated in the second chamber to the first chamber via the supply port; and a return port permitting the developer contained in the first chamber to fall into the second chamber; and an moving member configured to be move between an open position for opening the return port and a closed position for closing the return port, wherein, in a case where moving member is in the closed position, the supply port is open and allows the developer accommodated in the second chamber to move to the first chamber.

8. The developing apparatus according to claim 7, wherein the moving member is disposed in the first chamber.

9. The developing apparatus according to claim 7, further comprising a supply member disposed in the first chamber and configured to supply the developer to the developing roller.

10. The developing apparatus according to claim 9, further comprising a wall portion disposed between the supply member and the return port.

11. The developing apparatus according to claim 7, further comprising a driving mechanism configured to move the moving member.

12. The developing apparatus according to claim 7, further comprising a seal member disposed between the partition wall and the moving member.

13. The developing apparatus according to claim 7, wherein the moving member includes:

a main body portion; and a support portion protruding from a lower portion of the main body portion, the main body portion being swingable with respect to the support portion.

14. The developing apparatus according to claim 13, wherein the casing includes a stopper configured to regulate a movement of the support portion of the moving member in an up-down direction.

15. The developing apparatus according to claim 14, wherein the support portion of the moving member is disposed between the stopper and the partition wall.

16. The developing apparatus according to claim 13, wherein the main body portion has a hole, and wherein the moving member further includes a shaft portion inserted into the hole of the main body portion.

17. The developing apparatus according to claim 10, wherein the moving member includes the wall portion.

18. The developing apparatus according to claim 11, wherein the driving mechanism includes a driving gear.

* * * * *